US007284591B2

(12) United States Patent
Anderson

(10) Patent No.: US 7,284,591 B2
(45) Date of Patent: Oct. 23, 2007

(54) PERIMETER WALL LUBRICATION SYSTEM FOR MOLTEN METAL MOLDS

(75) Inventor: Michael K. Anderson, Otis Orchards, WA (US)

(73) Assignee: Wagstaff, Inc., Spokane, WA (US)

( * ) Notice: Subject to any disclaimer, the term of this patent is extended or adjusted under 35 U.S.C. 154(b) by 0 days.

(21) Appl. No.: 11/331,595

(22) Filed: Jan. 13, 2006

(65) Prior Publication Data

US 2007/0163746 A1 Jul. 19, 2007

(51) Int. Cl.
*B22D 11/12* (2006.01)

(52) U.S. Cl. ..... 164/268; 164/472; 164/487; 164/418

(58) Field of Classification Search ..... 164/268, 164/472, 487, 418
See application file for complete search history.

(56) References Cited

U.S. PATENT DOCUMENTS 4,598,763 A * 7/1986 Wagstaff et al. ..... 164/472
5,873,405 A * 2/1999 Carrier et al. ..... 164/472
6,609,557 B1 8/2003 Anderson
6,808,009 B2 10/2004 Anderson

* cited by examiner

*Primary Examiner*—Kevin Kerns
*Assistant Examiner*—I.-H. Lin
(74) *Attorney, Agent, or Firm*—Wells St. John, P.S.

(57) ABSTRACT

A perimeter wall lubrication system for molten metal molds wherein the lubricant conduit within the permeable perimeter wall is configured with a K constant which is lower than 40 or more in the equation where X is the perimeter of the groove in the permeable perimeter wall and Y is the perimeter to area ratio, relative to the equation k=XY in a plot of the respective values.

9 Claims, 15 Drawing Sheets

Fig 14
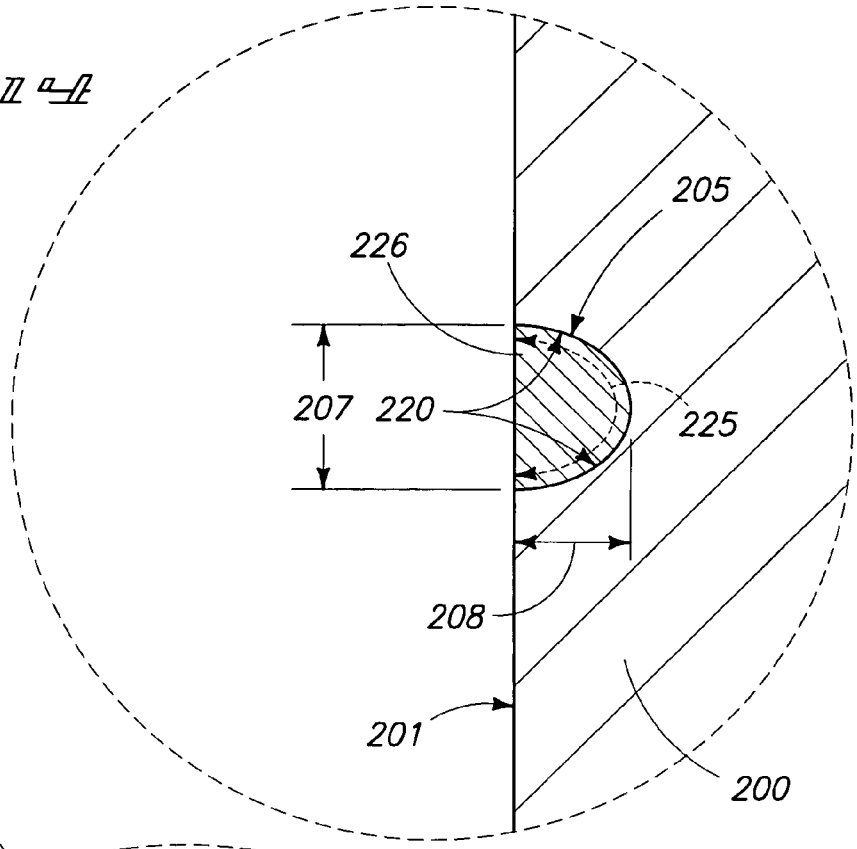
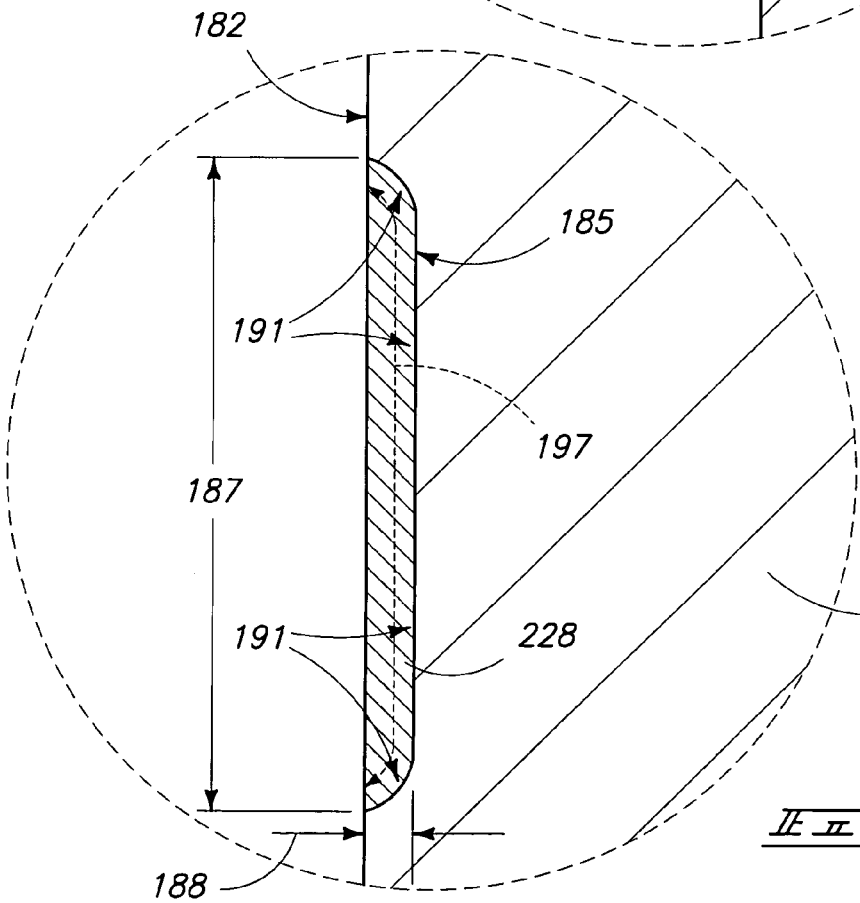
Fig 15

PERIMETER WALL LUBRICATION SYSTEM FOR MOLTEN METAL MOLDS

CROSS REFERENCE TO RELATED APPLICATION

This application does not claim priority from any other application.

TECHNICAL FIELD

This invention pertains to a system for providing more uniform lubricant flow throughout the perimeter of permeable perimeter walls in metal casting molds.

BACKGROUND OF THE INVENTION

Metal ingots, billets and other castparts may be formed by a casting process, which utilizes a vertically oriented mold situated above a large casting pit beneath the floor level of the metal casting facility, although this invention may also be utilized in horizontal molds. The lower component of the vertical casting mold is a starting block. When the casting process begins, the starting blocks are in their upward-most position and in the molds. As molten metal is poured into the mold bore or cavity and cooled (typically by water), the starting block is slowly lowered at a pre-determined rate by a hydraulic cylinder or other device. As the starting block is lowered, solidified metal or aluminum emerges from the bottom of the mold and ingots, rounds or billets of various geometries are formed, which may also be referred to herein as castparts.

While the invention applies to the casting of metals in general, including without limitation aluminum, brass, lead, zinc, magnesium, copper, steel, etc., the examples given and preferred embodiment disclosed may be directed to aluminum, and therefore the term aluminum or molten metal may be used throughout for consistency even though the invention applies more generally to metals.

While there are numerous ways to achieve and configure a vertical casting arrangement, FIG. 1 illustrates one example. In FIG. 1, the vertical casting of aluminum generally occurs beneath the elevation level of the factory floor in a casting pit. Directly beneath the casting pit floor 101*a* is a caisson 103, in which the hydraulic cylinder barrel 102 for the hydraulic cylinder is placed.

As shown in FIG. 1, the components of the lower portion of a typical vertical aluminum casting apparatus, shown within a casting pit 101 and a caisson 103, are a hydraulic cylinder barrel 102, a ram 106, a mounting base housing 105, a platen 107 and a starting block base 108 (also referred to as a starting head or bottom block), all shown at elevations below the casting facility floor 104.

The mounting base housing 105 is mounted to the floor 101*a* of the casting pit 101, below which is the caisson 103. The caisson 103 is defined by its side walls 103*b* and its floor 103*a*.

A typical mold table assembly 110 is also shown in FIG. 1, which can be tilted as shown by hydraulic cylinder 111 pushing mold table tilt arm 110*a* such that it pivots about point 112 and thereby raises and rotates the main casting frame assembly, as shown in FIG. 1. There are also mold table carriages which allow the mold table assemblies to be moved to and from the casting position above the casting pit.

FIG. 1 further shows the platen 107 and starting block base 108 partially descended into the casting pit 101 with castpart or billet 113 being partially formed. Ingot 113 is on the starting block base 108, which may include a starting head or bottom block, which usually (but not always) sits on the starting block base 108, all of which is known in the art and need not therefore be shown or described in greater detail. While the term starting block is used for item 108, it should be noted that the terms bottom block and starting head are also used in the industry to refer to item 108, bottom block typically used when an ingot is being cast and starting head when a billet is being cast.

While the starting block base 108 in FIG. 1 only shows one starting block 108 and pedestal 115, there are typically several of each mounted on each starting block base, which simultaneously cast billets, special shapes or ingots as the starting block is lowered during the casting process.

When hydraulic fluid is introduced into the hydraulic cylinder at sufficient pressure, the ram 106, and consequently the starting block 108, are raised to the desired elevation start level for the casting process, which is when the starting blocks are within the mold table assembly 110.

The lowering of the starting block 108 is accomplished by metering the hydraulic fluid from the cylinder at a pre-determined rate, thereby lowering the ram 106 and consequently the starting block at a pre-determined and controlled rate. The mold is controllably cooled during the process to assist in the solidification of the emerging ingots or billets, typically using water cooling means.

There are numerous mold and casting technologies that fit into mold tables, and no one in particular is required to practice the various embodiments of this invention, since they are known by those of ordinary skill in the art.

The upper side of the typical mold table operatively connects to, or interacts with, the metal distribution system. The typical mold table also operatively connects to the molds which it houses.

When metal is cast using a continuous cast vertical mold, the molten metal is cooled in the mold and continuously emerges from the lower end of the mold as the starting block base is lowered. The emerging billet, ingot or other configuration is intended to be sufficiently solidified such that it maintains its desired shape. There is an air gap between the emerging solidified metal and the permeable ring wall. Below that, there is also a mold air cavity between the emerging solidified metal and the lower portion of the mold and related equipment.

After a particular cast is completed, as described above, the mold table is typically tilted upward and away from the top of the casting pit, as shown in FIG. 1. When the mold table is tilted or pivoted, and without a lubricant control system, the lubricant tends to drain out of the conduits and leaks either into the casting pit or on the floor of the casting facility.

The use of a permeable or porous perimeter wall has proven to be an effective and efficient way to distribute lubricant and gas to the inside surface of a continuous casting mold, such as is described in U.S. Pat. No. 4,598,763 to Wagstaff, which is hereby incorporated herein by this reference as though fully set forth herein.

In the typical use of a permeable perimeter wall, lubricant and gas are delivered to the perimeter wall under pressure through grooves or delivery conduits around the perimeter wall, typically using one delivery conduit (if grooves are used for the delivery of lubricant) and one or two delivery conduits (grooves) for the delivery of gas. The preferred lubricants are synthetic oils, whereas the current preferred gas is air. The lubricant and gas then permeate through the perimeter wall and are delivered to the interior of the mold as part of the casting process.

The perimeter walls on existing mold tables each have delivery conduits to deliver the lubricant and/or gas, and the delivery conduits may be circumferential groove-shaped delivery conduits with the same depth and width, or they may be holes partially drilled through the perimeter walls, or any other delivery means for that matter. The typical perimeter wall has a separate lubricant delivery conduit and a gas conduit.

Although this invention is not limited to graphite, graphite has proven to be the preferred permeable material for use as the perimeter wall material or media. However, graphite has proven to be expensive in consistently producing high quality individual products which have very similar permeability to other graphite perimeter walls.

Prior to this invention, achieving the same flow rate or delivery rate of lubricant and/or gas flow through the entire perimeter of the perimeter walls is not being achieved to the degree desired, and this may result in a less desirable castpart and waste.

From a practical and expense perspective, lubricant and/or gas are supplied at a constant pressure, and the perimeter walls are manufactured at a constant or fixed thickness and general size to fit within the molds. The inner and outer diameters of the perimeter walls, as well as their overall height also is generally fixed.

It is an objective of this invention to provide a more even flow of lubricant through more of the perimeter wall, and preferably through the entire perimeter wall.

This invention accomplishes this and other objectives by providing a system for providing an improved lubricant flow groove configuration substantially around the entire permeable perimeter wall to allow the lubricant to permeate through the permeable perimeter wall and toward the mold cavity.

Other objects, features, and advantages of this invention will appear from the specification, claims, and accompanying drawings which form a part hereof. In carrying out the objects of this invention, it is to be understood that its essential features are susceptible to change in design and structural arrangement, with only one practical, and preferred embodiment being illustrated in the accompanying drawings, as required.

BRIEF DESCRIPTION OF THE DRAWINGS

Preferred embodiments of the invention are described below with reference to the following accompanying drawings.

FIG. 14 is detail C from FIG. 12;

FIG. 15 is detail D from FIG. 10;

FIG. 16 is a graph showing the perimeter to area ratio of the lubrication conduit for a half-circle conduit;

FIG. 17 is a graph showing the perimeter to area ratio of the lubrication conduit for a rectangle with an aspect ratio of 3 to 1; and FIG. 18 is a graph showing the perimeter to area ratio of the lubrication conduit for a square conduit.

DETAILED DESCRIPTION OF THE PREFERRED EMBODIMENTS

Figure 1:
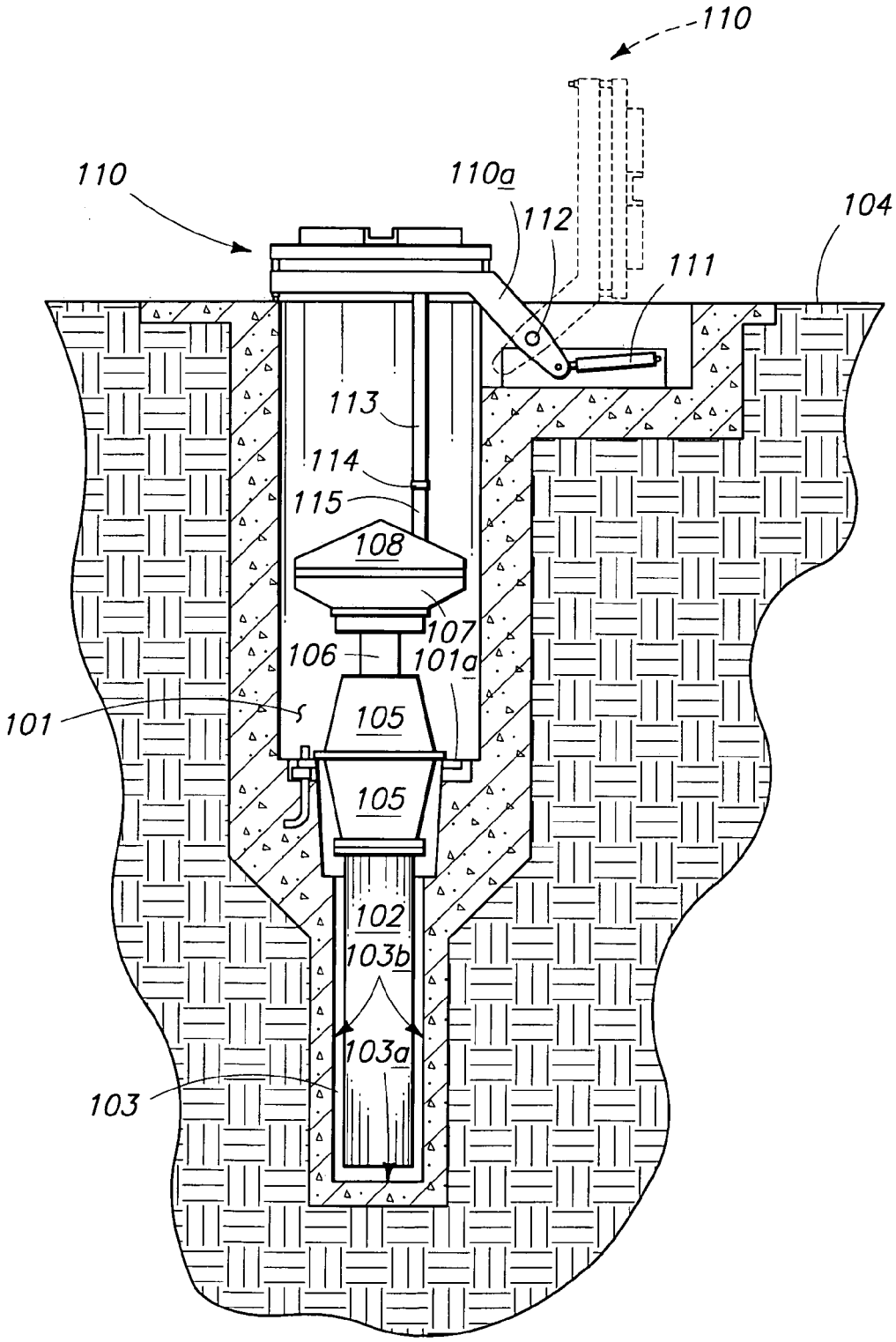
FIG. 1 is an elevation view of a prior art vertical casting pit, caisson and metal casting apparatus.

Many of the fastening, connection, manufacturing and other means and components utilized in this invention are widely known and used in the field of the invention described, and their exact nature or type is not necessary for an understanding and use of the invention by a person skilled in the art or science; therefore, they will not be discussed in significant detail. Furthermore, the various components shown or described herein for any specific application of this invention can be varied or altered as anticipated by this invention and the practice of a specific application or embodiment of any element may already be widely known or used in the art or by persons skilled in the art or science; therefore, each will not be discussed in significant detail.

The terms "a", "an", and "the" as used in the claims herein are used in conformance with long-standing claim drafting practice and not in a limiting way. Unless specifically set forth herein, the terms "a", "an", and "the" are not limited to one of such elements, but instead mean "at least one".

The mold therefore must be able to receive molten metal from a source of molten metal, whatever the particular source type is. The mold cavities in the mold must therefore be oriented in fluid or molten metal receiving position relative to the source of molten metal.

It is to be understood that this invention applies to and can be utilized in connection with various types of metal casting and pour technologies and configurations, including but not limited to both hot top technology and conventional pour technology. It is further to be understood that this invention may be used on horizontal or vertical casting devices.

The term around is not limited to being continuous all the way around the object such as the mold cavity, but instead substantially around it. The term circumferential as used herein in reference to the delivery conduits around the perimeter wall, is not limited to a delivery conduit or item which extends around the entire circumference, but instead also includes one which extends partially, but not wholly around the circumference. The delivery conduits may therefore extend around the entire circumference of the perimeter wall.

When the term permeable is used herein with permeable perimeter wall body, the entire perimeter wall body does not necessarily have to be permeable, but instead only that portion through which lubricant and/or gas flow is desired. The term castpart or metal castpart as used herein means any castpart solidified during the casting process with no one in particular being required to practice the invention, including without limitation, rounds, billets, ingots and any one of a number of various other shaped configurations as are known in the trade.

The preferred perimeter walls contemplated by this invention are generally rigid or solid, but they need not be as they may be semi-rigid or semi-solid within the contemplation of this invention. It will also be appreciated by those skilled in the art that the perimeter wall contemplated by this invention may be practiced as a one piece perimeter wall, or a plurality of sections placed together to form the perimeter wall. This will be particularly applicable for special shaped molds.

The term flow rate as used herein in the claims may include not only the actual or measured flow rate, but also the estimated flow rate.

The depth and height of a lubricant delivery conduit or a gas delivery conduit define a surface area for each. Varying the delivery conduit surface area, or the surface area in general, where the lubricant or the gas is applied, will vary the overall flow rate of the lubricant and/or gas through the perimeter wall.

When it is referred to that the perimeter walls are disposed around each mold cavity, that is intended to mean that the perimeter wall is disposed about that part of the mold cavity wherein it may be used, such as is described in U.S. Pat. No. 4,598,763, which has been previously-incorporated herein by reference, or in other locations that those skilled in the art will appreciate. This would typically be at an intermediate location or an exit location of the mold cavity, as further illustrated in FIG. 2.

If the flow rate were more two dimensional, it would tend to follow Darcey's law more closely, or be easier to apply Darcey's law to it. However, since the flow is necessarily three dimensional, predictions may be made from Darcey's law, but the flow will be generally more difficult to predict. Furthermore, in some applications, the lubricant and the gas may be mixed as it is delivered to the media, in which case the flow rate may further vary from or become less predictable from Darcey's law. The more variance there is from Darcey's law, the more that empirical data will need to be relied upon.

FIG. 1 is an elevation view of a typical prior art vertical casting pit, caisson and metal casting apparatus, and is described in more detail above.

Figure 2:
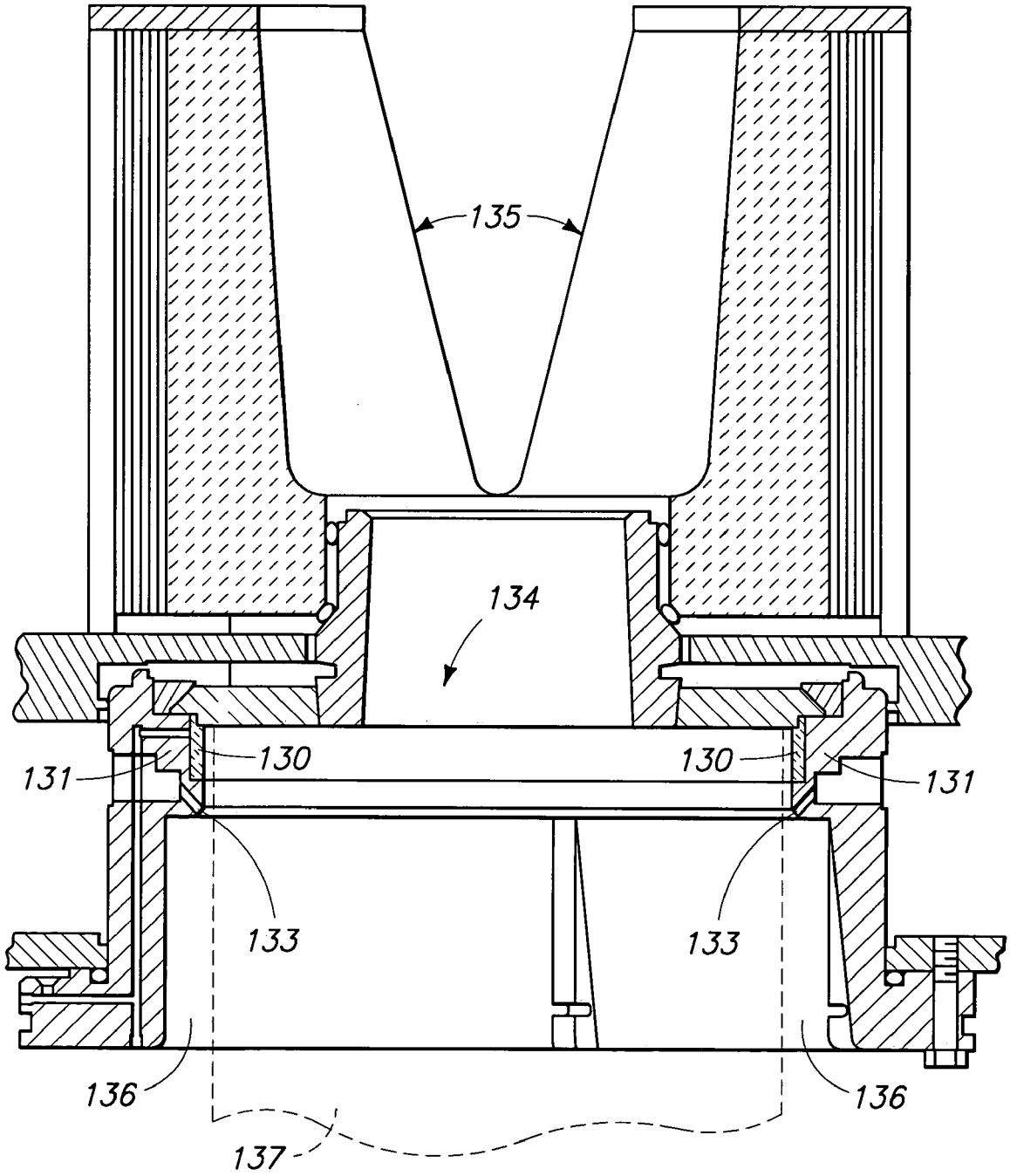
FIG. 2 is a FIG. 2 is a cross sectional elevation view of a typical prior art mold casting assembly, illustrating the perimeter wall in place.

FIG. 2 illustrates a prior art perimeter wall 130 in place in a mold, and abutted against the mold housing 131. The mold housing 131 combined with the lubricant and gas delivery conduits in the perimeter wall form the lubricant and gas passageways through which the lubricant and gas are provided to permeate through the perimeter wall 130. Coolant is introduced to solidify the emerging metal through coolant passageways 133.

FIG. 2 further illustrates the mold inlet 134, the refractory troughs 135 for directing the molten metal to the mold inlet 134. The embodiment in FIG. 2 illustrates an emerging solidified billet 137, and the mold air cavity 136 surrounding the billet 137.

It should be noted that the air cavity 136 is different than what is referred to in the industry as the air gap or air slip. The air gap or air slip is the layer or area of air which occurs between the perimeter wall 130 and the metal passing through the perimeter wall 130 during casting.

Figure 3:
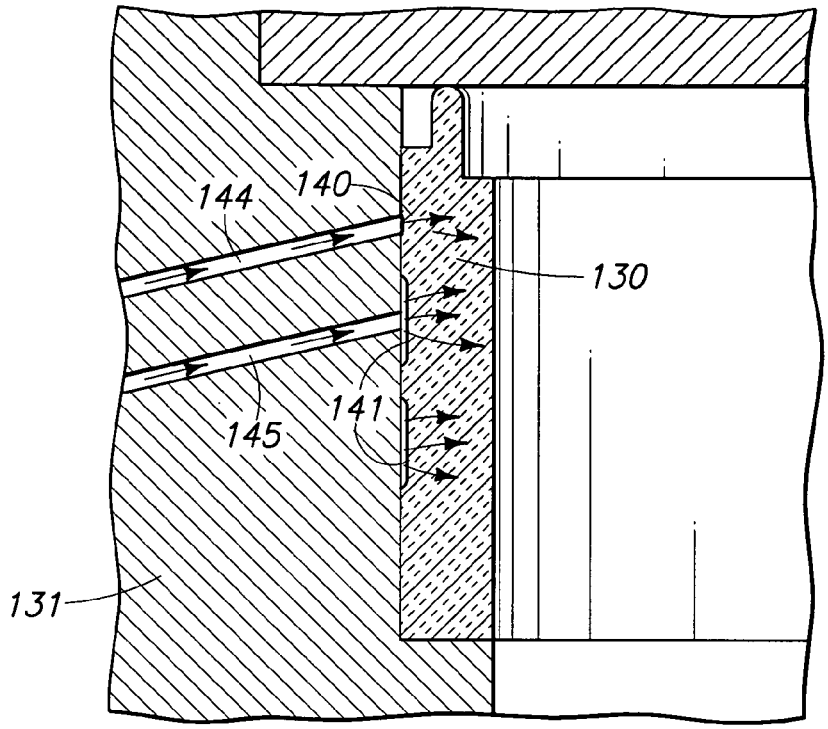
FIG 3 PRIOR ART
FIG. 3 is a cross sectional view of a prior art perimeter wall seated in a mold housing, illustrating the flow of lubricant and/or gas through its body.

FIG. 3 is a cross sectional view of an embodiment of a perimeter wall 130 contemplated by this invention, seated in a mold housing 131. The gas inlet line 145 and the lubricant inlet line 144 are also shown, and illustrate how lubricant and gas may be provided to the lubricant delivery conduit 140 and the gas delivery conduits 141.

Figure 4:
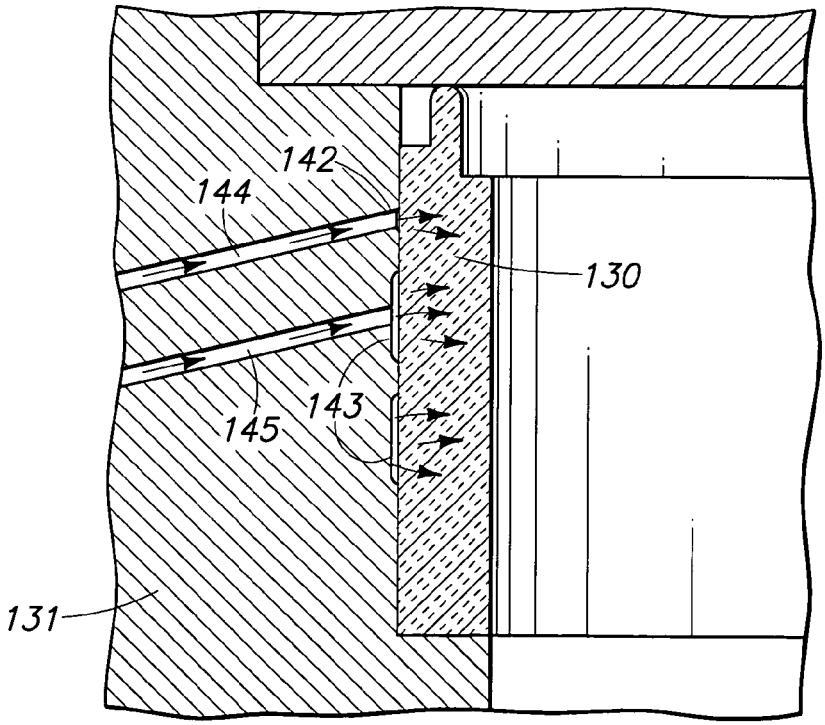
FIG 4 PRIOR ART
FIG. 4 is a cross sectional view of a prior art perimeter wall seated in a mold housing, illustrating the flow of lubricant and/or gas through its body, only wherein the delivery conduits are in the mold housing.

FIG. 4 is also a cross sectional view of an embodiment of a perimeter wall 130 contemplated by this invention, seated in a mold housing 131, and further illustrating an embodiment wherein the lubricant delivery conduit 142 and the gas delivery conduits 143 are within the mold housing 131. The gas inlet line 145 and the lubricant inlet line 144 are also shown, and illustrate how lubricant and gas may be provided to the lubricant delivery conduit 142 and the gas delivery conduits 143.

Figure 5:
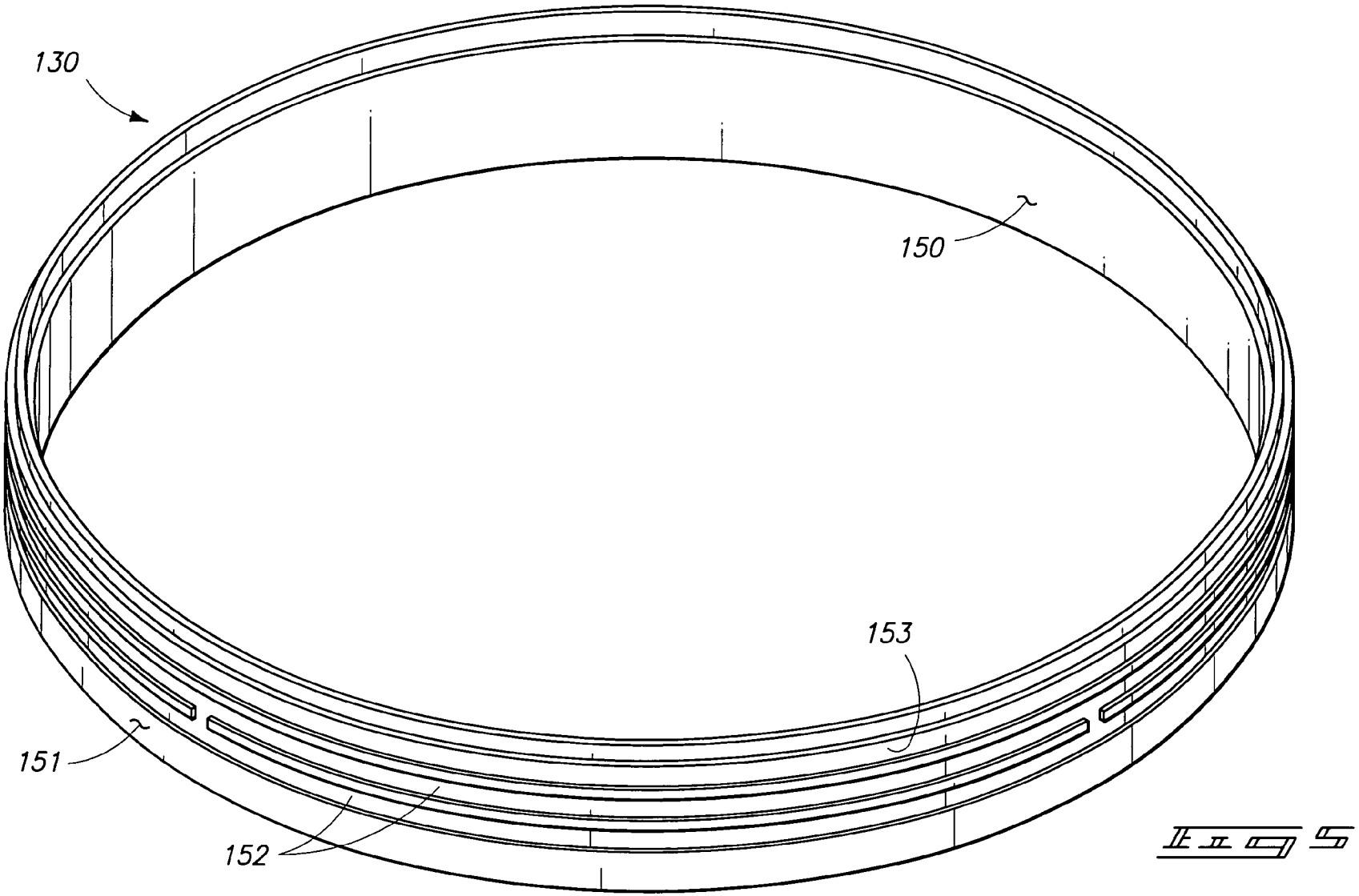
FIG. 5 is a perspective of a prior art perimeter wall.

FIG. 5 is a perspective of one embodiment of a perimeter wall 130 which is contemplated for use by this invention, and illustrates the inner surface 150, the outer surface 151, gas delivery conduits 152 and lubricant delivery conduit 153. The two gas delivery conduits 152 are shown in operative connection to one another.

Figure 6:
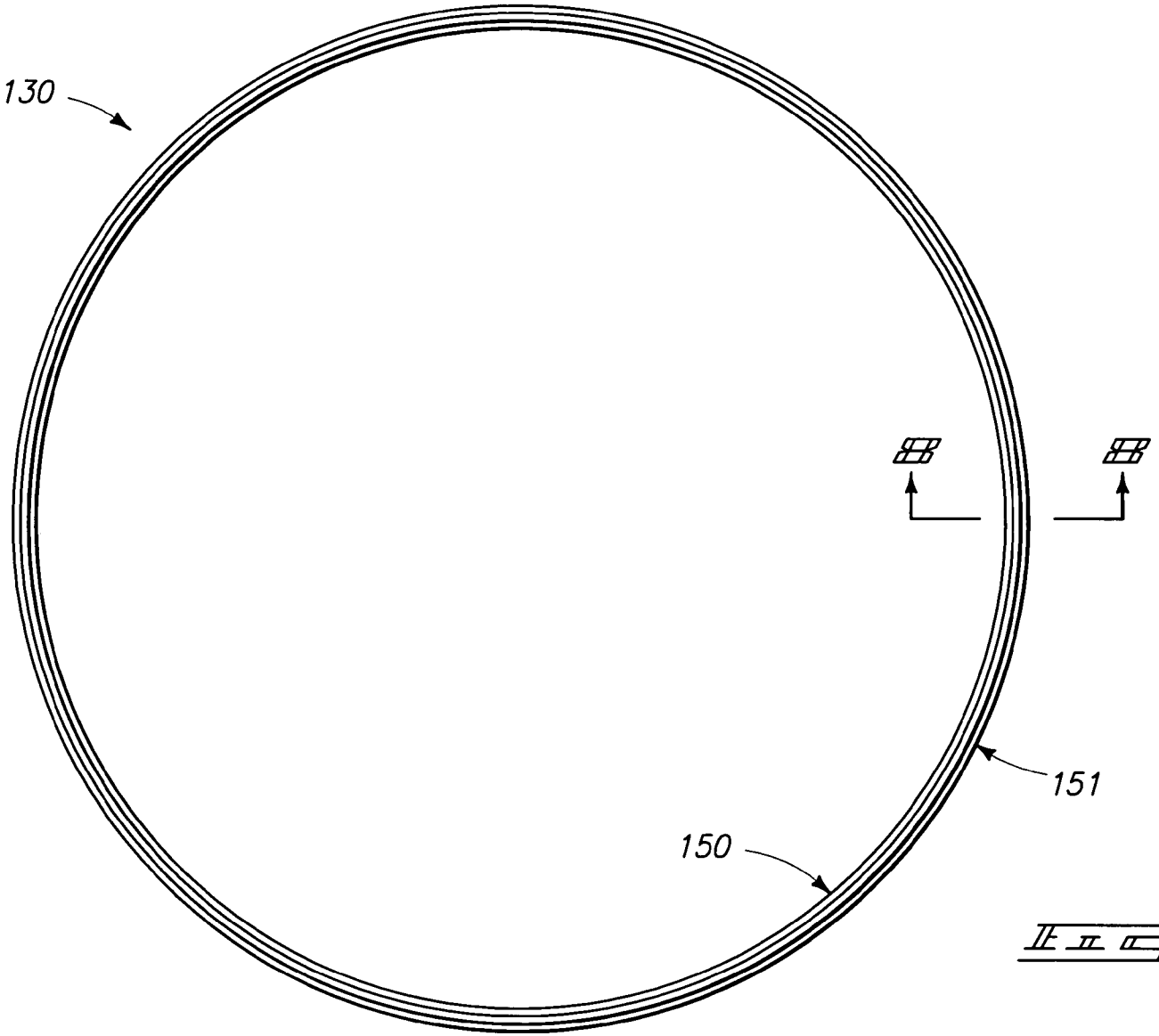
FIG. 6 is a top view of the prior art perimeter wall illustrated in FIG. 5.

FIG. 6 is a top view of the perimeter wall 130 illustrated in FIG. 5, also illustrating the inner surface 150 and the outer surface 151.

Figure 7:
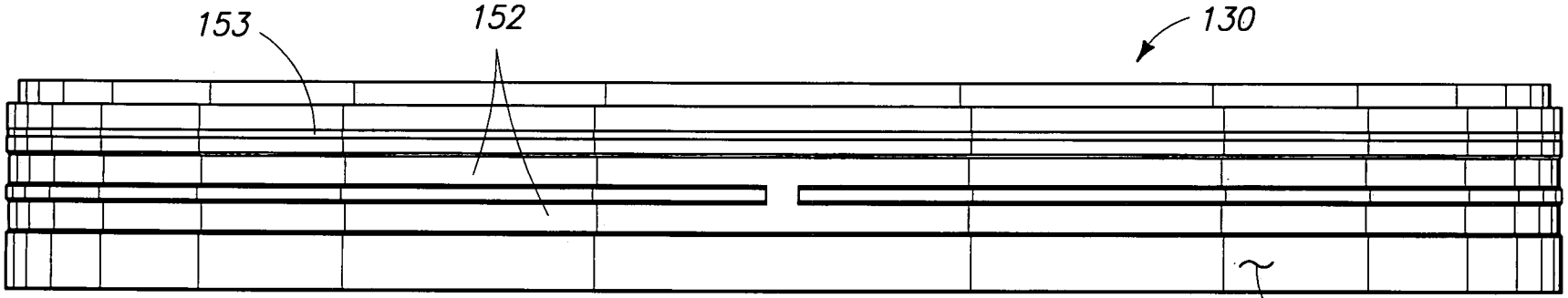
FIG. 7 is an elevation view of the prior art perimeter wall illustrated in FIG. 5.

FIG. 7 is an elevation view of the perimeter wall 130 illustrated in FIG. 5, and illustrates the outer surface 151, gas delivery conduits 152 and lubricant delivery conduit 153.

Figure 8:
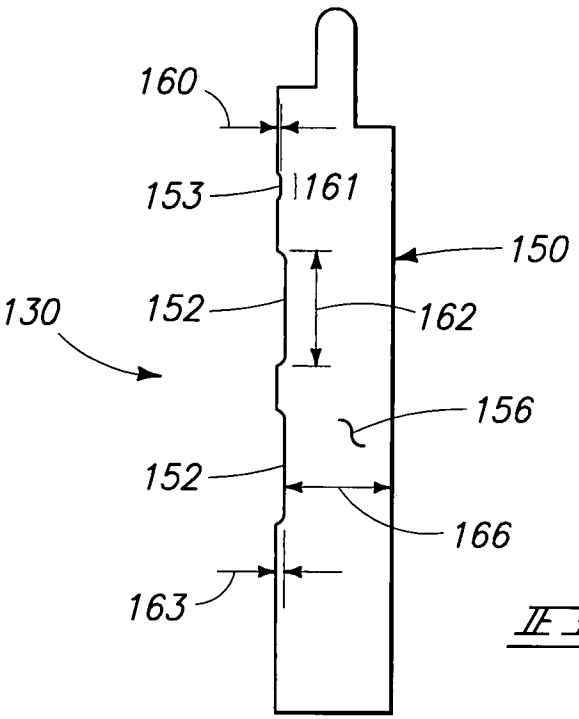
FIG. 8 is section 8-8 from the prior art perimeter wall illustrated in FIG. 6.

FIG. 8 is Section 8-8 from the perimeter wall illustrated in FIG. 6, and shows the cross section of one embodiment of the invention. FIG. 8 illustrates perimeter wall 130, perimeter wall body 156, lubricant delivery conduit 153, lubricant delivery conduit height 161, lubricant delivery conduit depth 160, gas delivery conduits 152, gas delivery conduit height 162, and gas delivery conduit depth 163.

FIG. 8 further illustrates the delivery distance 166 from the termination of a delivery conduit to the inner surface 150 of the perimeter wall 130.

Figure 9:
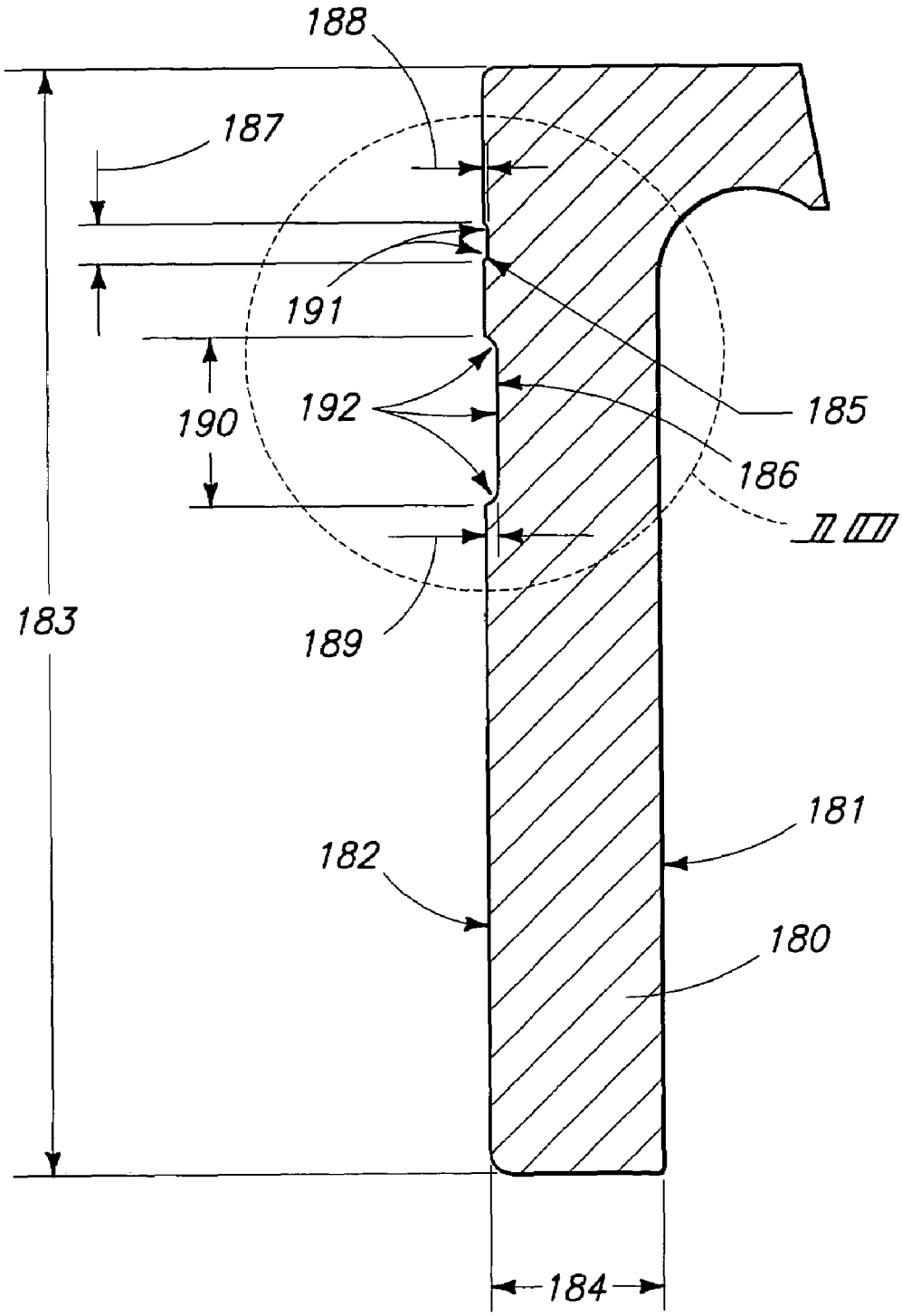
FIG 9 PRIOR ART
FIG. 9 is a section view of another prior art perimeter wall.

FIG. 9 is a section view of another prior art perimeter wall, illustrating perimeter wall body 180 with inner surface 181, outer surface 182, general height 183, general width 184, lubricant conduit 185 and gas conduit 186 in outer surface 182. FIG. 9 illustrates the prior art configuration for lubricant conduit 185, which includes surface area 191, height 187 and width 188 (or depth). It is applicants belief that the lubrication conduits in the perimeter walls of prior art systems have generally been limited to the configuration and relative dimensions as shown in FIG. 9, with the width 188 being approximately eight one-thousandths of an inch and the height 187 being approximately seventy one-thousandths of an inch.

FIG. 9 further illustrates a general prior art configuration for the gas conduit 186, which includes surface area 192, height 190 and width 189.

Figure 10:
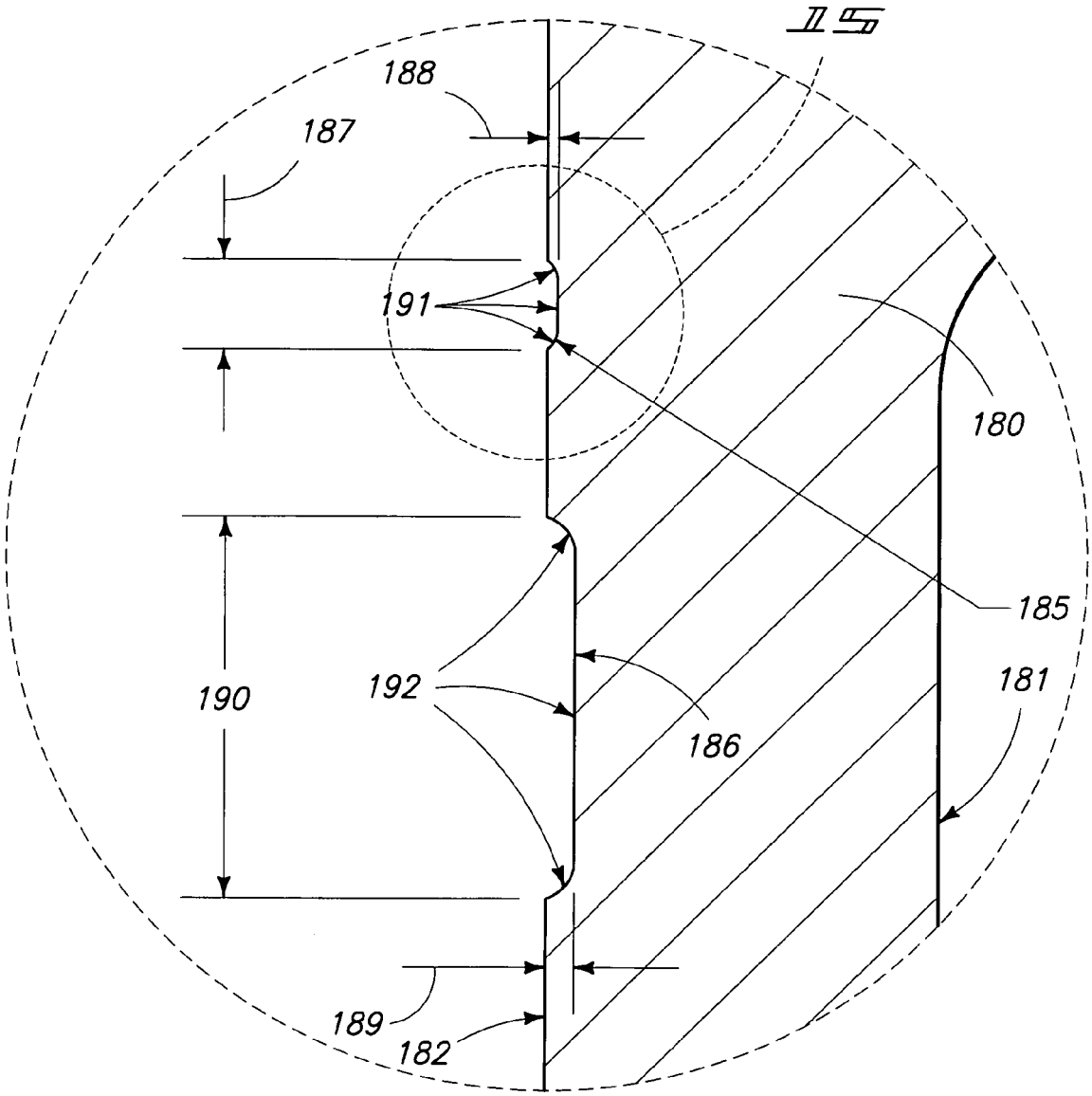
FIG 10 PRIOR ART
FIG. 10 is detail A from FIG. 9.

FIG. 10 is detail A from FIG. 9, and more clearly illustrates perimeter wall body 180 with inner surface 181, outer surface 182, lubricant conduit 185 and gas conduit 186 in outer surface, surface area 191 of lubricant conduit 185, the height 187 of lubricant conduit 185, and the width 188 (or depth) of lubricant conduit 185. FIG. 10 further illustrates the gas conduit 186, which includes surface area 192, height 190 and width 189.

Figure 11:
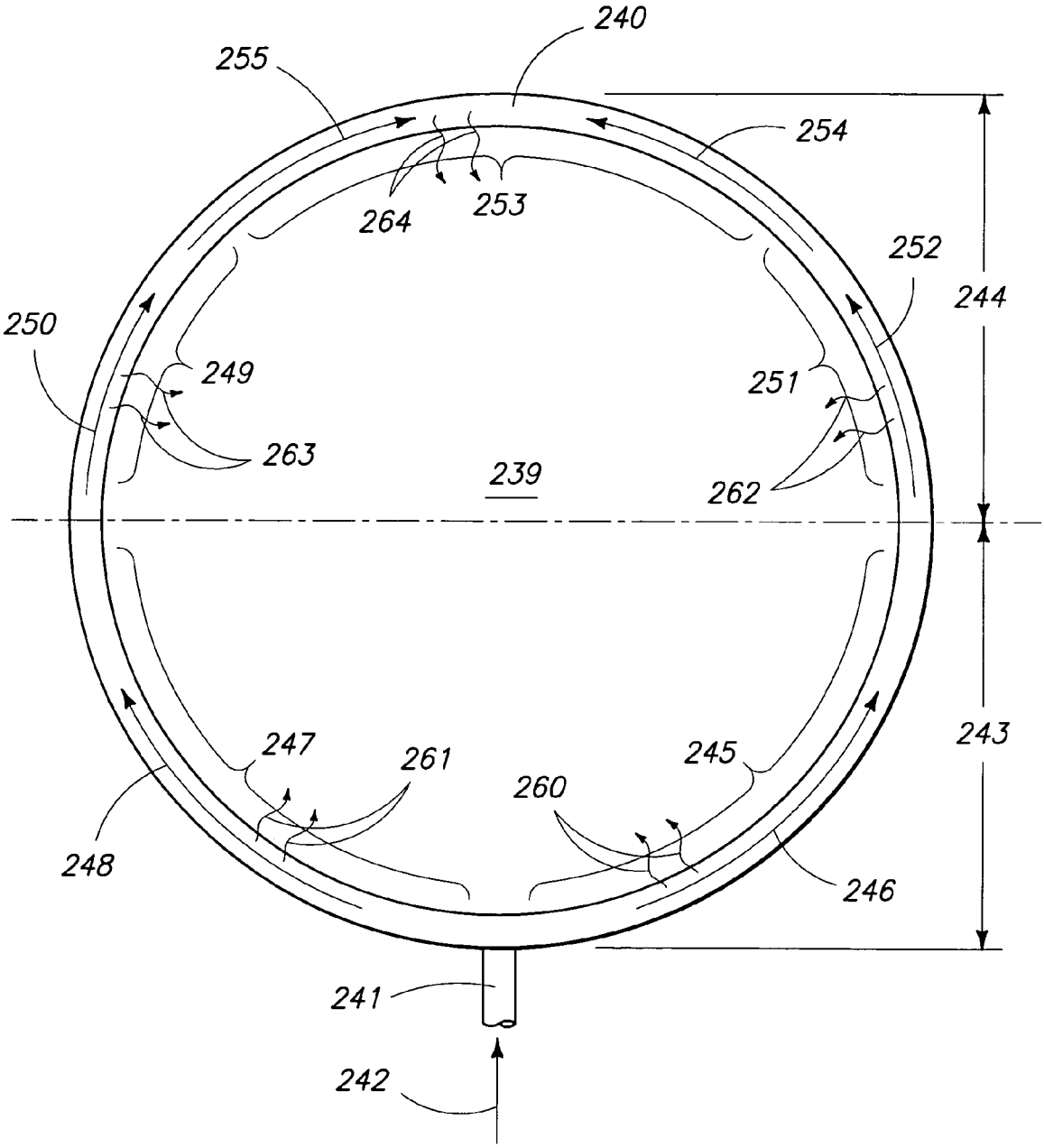
FIG. 11 is a schematic top view of a perimeter wall and the representative lubricant flow around the perimeter wall.

FIG. 11 is a schematic top view of a perimeter wall 240 around a mold cavity 239, and the representative lubricant flow around the perimeter wall 240 from a lubricant inlet 241 (with the lubricant flow in being represented by arrow 242). In typical prior art perimeter walls, the lubricant has one inlet and must flow all the way around the perimeter wall to then be more desirably applied around the molten metal or castpart being molded. It is for example desirable to have the lubricant flow approximately equal throughout the perimeter wall in most vertical casting applications.

However due to the prior art configurations of the lubricant conduits, the flow is not as equal or close to that desired as is possible when this invention is incorporated into perimeter wall configuration.

FIG. 11 schematically depicts lubricant flow around a perimeter wall 240. Typically the flow near the lubricant inlet 241, in regions 245 and 247 for example, is a higher volume or flow rate due to the proximity to the source of lubricant at the lubricant inlet 241. The first half 243 or first side of the perimeter wall 240 nears the lubricant inlet 241 therefore receives the greater lubricant flow than the remote or second half 244 of the perimeter wall 240. The lubricant flow 246 in region 245 and the lubricant flow 248 in region 247 will generally be greater than in regions in the second half 244 of the perimeter wall 240, resulting in earlier or perhaps greater lubricant flow through the perimeter wall 240, as represented by arrows 261 and 260 for regions 247 and 245 respectively.

In the second half 244, more remote from the lubricant inlet 241, the lubricant flows 252 and 250 may decrease in region 249 and region 251 respectively, which may result in a lesser and/or lesser lubricant flow 263 and 262 respectively, through those regions (regions 249 and 251) of the perimeter wall 240. The most remote region 253 typically receives the last and/or least amount of lubricant flow 254 and 255 through the lubricant conduit (not shown in FIG. 11). This may result in a reduced and/or later lubricant flow 264 through region 253 of perimeter wall 240 and to the portion of the molten metal or castpart adjacent thereto.

In certain casting applications, having non-uniform flow of lubricant through the perimeter wall at different regions of the perimeter wall is not desired, whereas in others it may be desired depending on the complicated nature of the shape of the castpart or the orientation of the mold (vertical casting versus horizontal, or any angle in between). While the perimeter wall 240 in this case is circular, this invention is not limited to any type or shape of perimeter wall 240.

It is believed that the typical prior art configuration of the lubrication conduit, such as shown as conduit 185 in FIG. 10, contributes to less desirable results in lubricant flow around the perimeter wall, and that a new system that incorporates changes thereto will provide more desirable lubricant flow results, as is discussed below.

Figure 12:
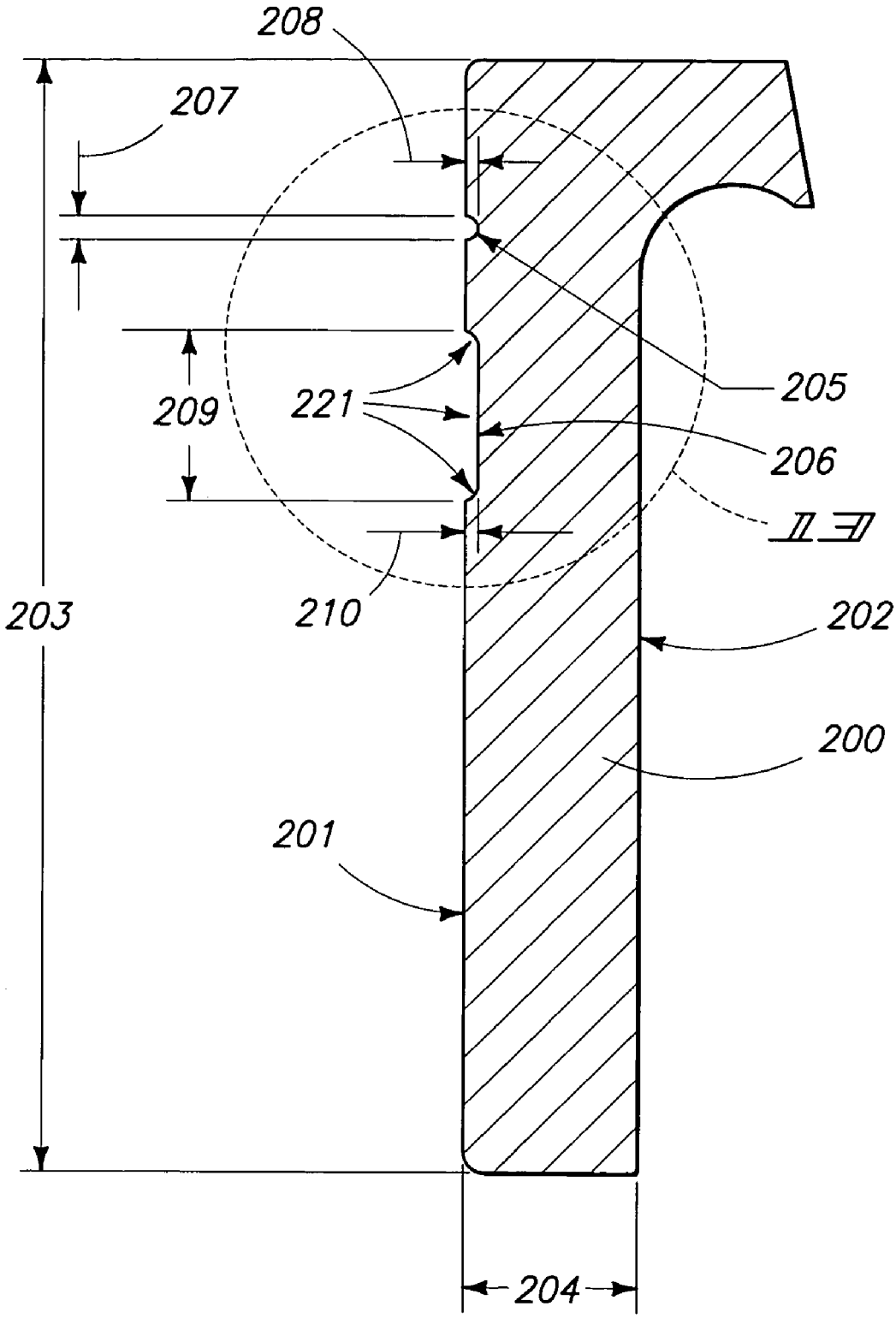
FIG. 12 is a section view of one embodiment of a perimeter wall contemplated by this invention.
Figure 13:
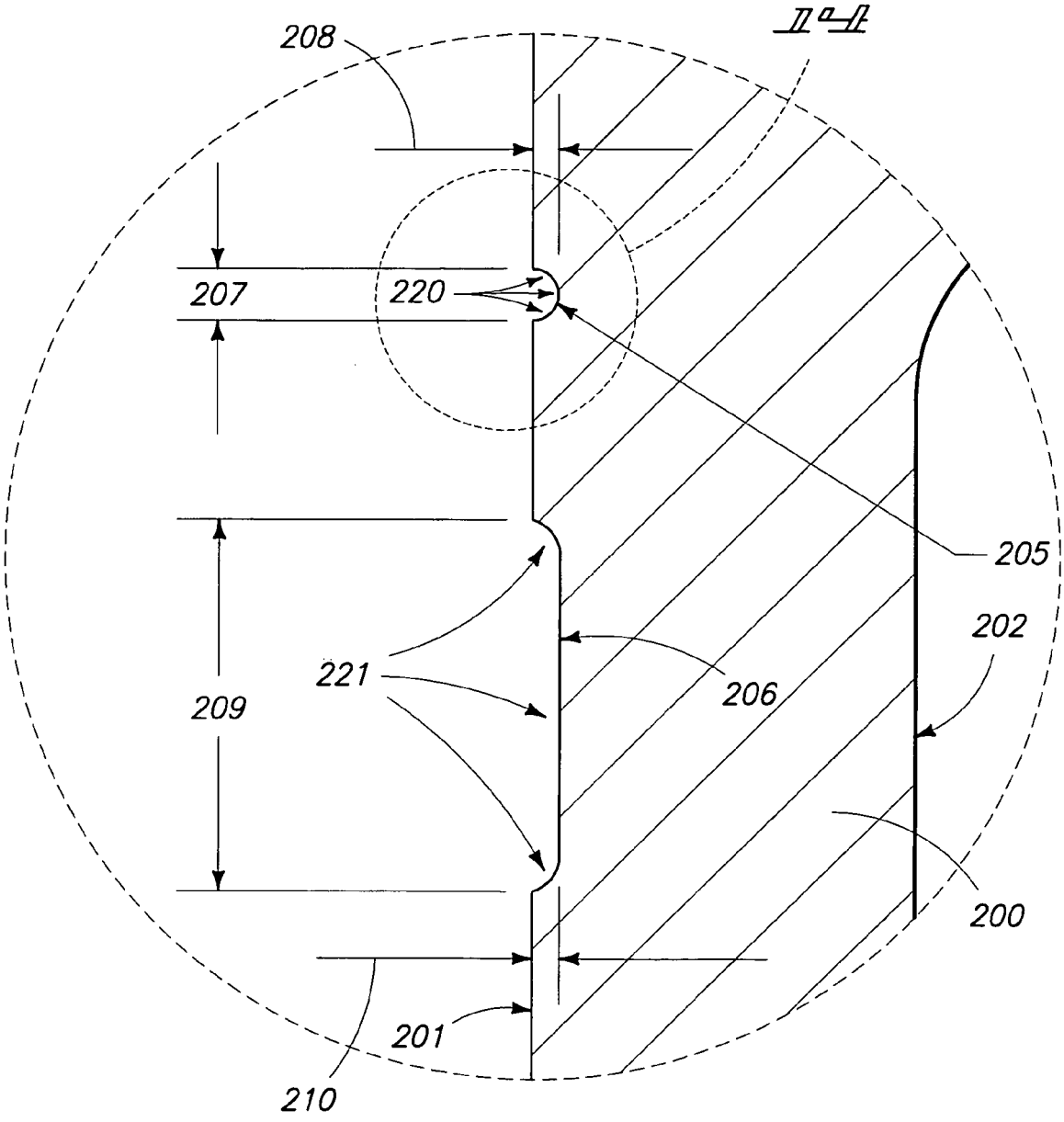
FIG. 13 is detail B from FIG. 11.
Figure 11:
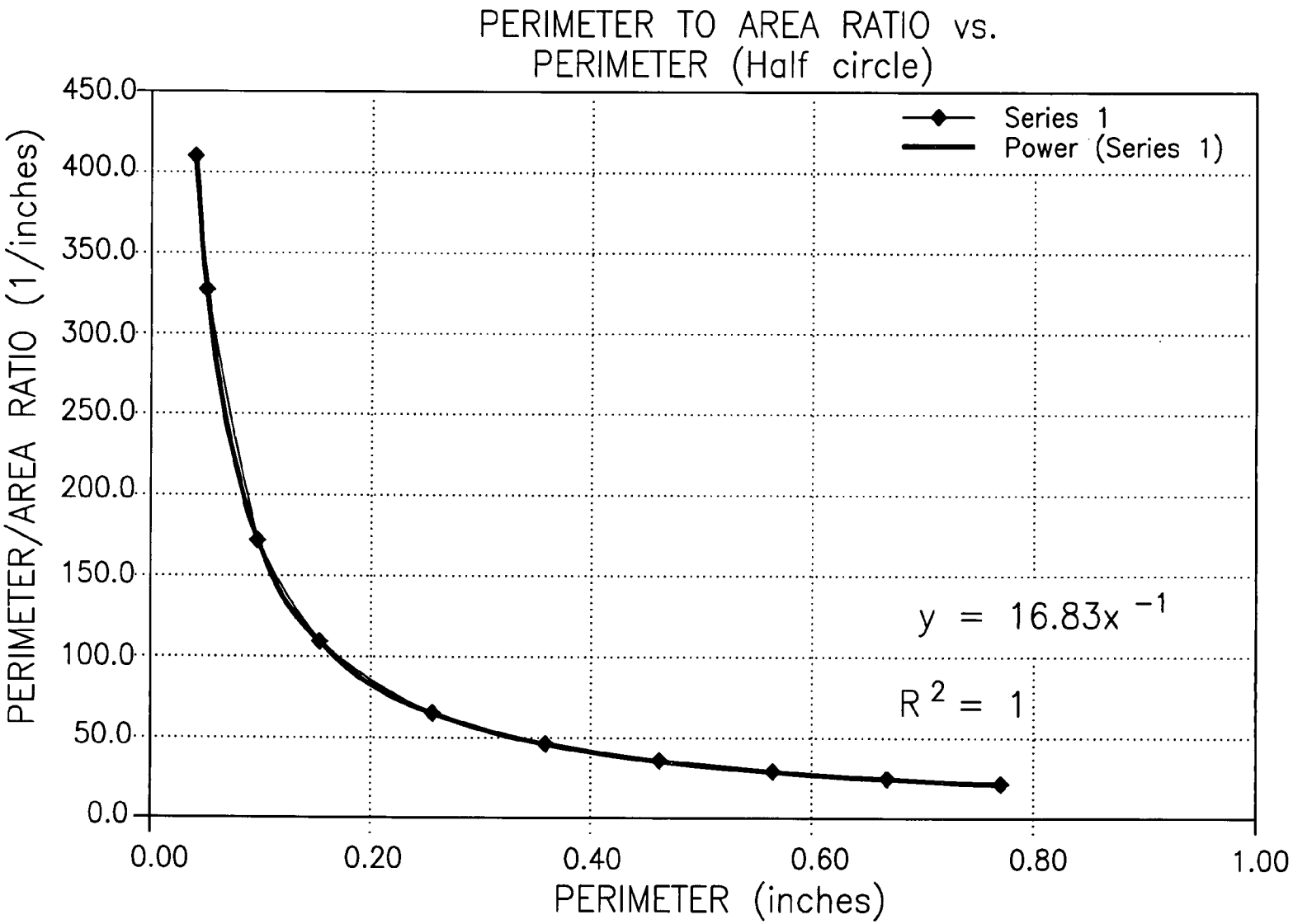
Figure 11:
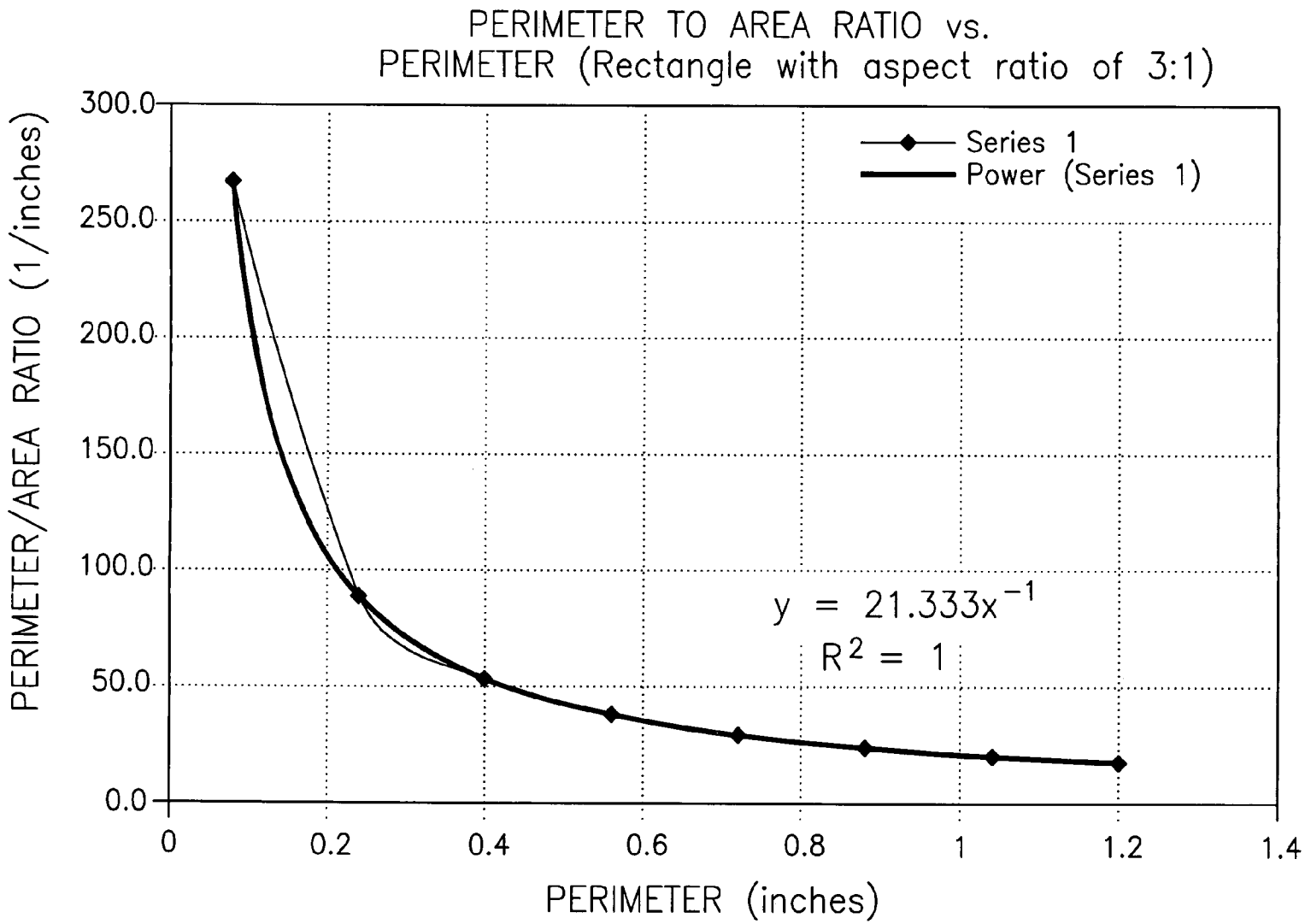
Figure 11:
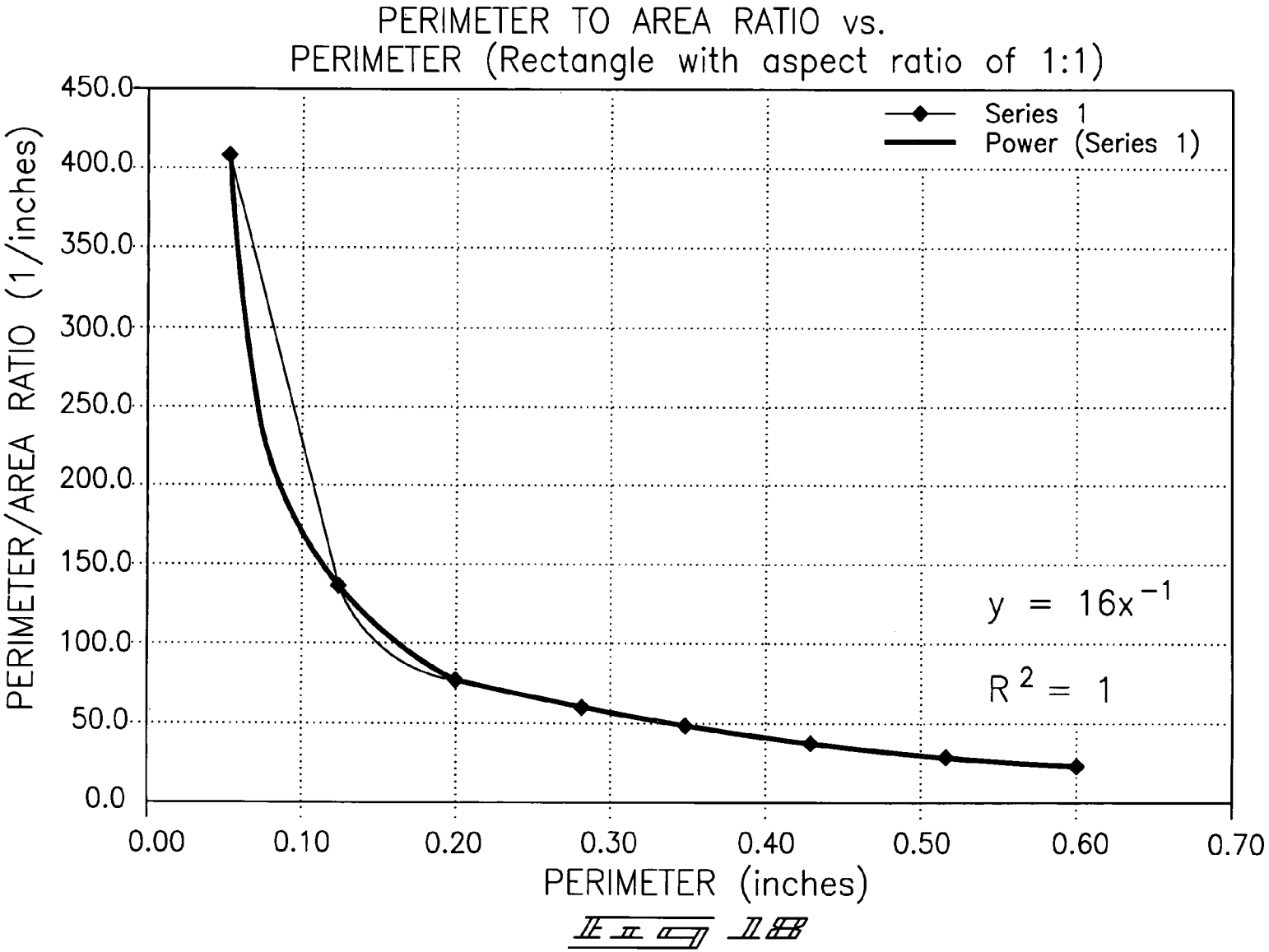

FIG. 12 is a section view of one embodiment of a perimeter wall contemplated by this invention, illustrating perimeter wall body 200 with inner surface 202, outer surface 201, general height 203, general width 204, lubricant conduit 205 and gas conduit 206 in outer surface 201. FIG. 12 illustrates lubricant conduit 205, with height 207 and width 208 (or depth). Detail B as illustrated in FIG. 13 further shows the configuration of lubricant conduit 206. FIG. 12 also illustrates a general prior art configuration for the gas conduit 206, which includes surface area 221, height 209 and width 210.

FIG. 13 is detail B from FIG. 12, and more clearly illustrates perimeter wall body 200 with inner surface 201, outer surface 202, lubricant conduit 205 and gas conduit 206 in outer surface, surface area 220 of lubricant conduit 205, the height 207 of lubricant conduit 205, and the width 208 (or depth) of lubricant conduit 205. FIG. 13 further illustrates the gas conduit 206, which includes surface area 221, height 209 and width 210.

FIG. 13 shows one embodiment of a lubricant groove or lubricant conduit 205 contemplated by this invention, which improves on the prior art groove shown in FIG. 15 and others. The optimized groove or lubrication conduit according to certain aspects of this invention, reduces lubricant flow resistance due to the configuration and relative sizing of the lubricant groove, which in this embodiment is one consistent size around the perimeter of the permeable perimeter wall.

In some embodiments of the invention, the resistance to the lubricant flow around the perimeter wall is reduced by reducing the amount of surface area in the lubricant conduit relative to the volumetric flow. This may also be referred to as the surface area to volume ratio, which in two dimensional terms, may be described as the perimeter to cross-sectional area ratio. This two dimensional perimeter to cross-sectional area ratio is not constant for a given shape of various areas; for example a square of one inch by one inch has a perimeter/area ratio of four inches, whereas a square of ten inches by ten inches has a perimeter to cross-sectional area ratio of four-tenths.

It will be further understood by those of ordinary skill in the art that certain shapes will normally or always have a lower perimeter to cross-sectional are ratio than others for the same area. For example, a square will generally be better than a rectangle or a triangle, and a circle will generally have the lowest perimeter to cross-sectional area ratio.

A plot of the perimeter to cross-sectional area ratio as a function of the perimeter, provides information helpful to improve upon the groove configuration to result in improved lubricant flow through the lubricant conduit(s) around the perimeter wall. The equation may be written as: $Y=k/X$ or $k=YX$ (with X and Y being the references to the axis of the plot). In the graphs, X is the perimeter of the portion of the lubricant conduit cut into the permeable perimeter wall and Y is the ratio of the perimeter of the lubricant conduit cut into the permeable perimeter wall versus the cross-sectional area of the lubricant conduit or groove in the permeable perimeter wall.

If Y and X are then substituted for by what they represent, the resulting equation of $k=YX$ becomes: $k=(P/A)P$ which equals $(P\times P)$ A, or P squared times the cross-sectional area. A consideration of the K values for a given lubricant conduit configuration may be utilized to improve the lubricant flow characteristics of the lubricant conduit and also therefore improve the lubricant flow characteristics of the lubricant through the permeable perimeter wall and to the molten metal or castpart being cast through the molten metal mold.

Considering the "k" factor in light of desiring to produce a more even or uniform flow of lubricant throughout the entire perimeter wall, will result in improved casting. The lubricant conduit or groove first then acts as a conduit to circulate the lubricant around the ring and secondly, it is the porous media through which the lubricant is distributed. The lubricant is typically pumped via pulsing, and while some lubricant escapes into the permeable perimeter wall (typically graphite) as it circulates around the ring, the lubricant as a fluid tends to take the path or least resistance, i.e. more through the lubricant conduit than permeating through the perimeter wall in an undesirable way.

It will be appreciated by those of ordinary skill in the art that the permeability of the perimeter wall is balanced with the volumetric flow of lubricant pump, and with the configuration of the groove based on the "k" factor. If the perimeter to cross-sectional are ratio is reduced, the porous surface area is reduced, which means less lubricant is transferred into the perimeter wall before the lubricant conduit is filled around the entire perimeter of the perimeter wall and the pressure is equalized. It is therefore desirable to decrease the "k" factor in the lubricant conduits or grooves to improve the lubricant flow.

For further example, in the prior art design shown in FIG. 15 for example, the "k" factor has been determined to be approximately forty-three and one-half, whereas for a half circle configuration, a "k" factor of approximately sixteen and eight-tenths has been achieved.

FIG. 14 is detail C from FIG. 13, and shows perimeter wall body 200 with outer surface 201, lubricant conduit 205 in outer surface, surface area 220 of lubricant conduit 205, the height 207 of lubricant conduit 205, and the width 208 (or depth) of lubricant conduit 205 and the cross sectional area 226 of lubricant conduit 205. The perimeter length 225 of the portion of the lubricant conduit 205 which is within the permeable perimeter body 200 is also shown in FIG. 14.

FIG. 15 is detail D from the prior art lubricant conduit 185 shown in FIG. 10, and shows perimeter wall body 180 with outer surface 182, lubricant conduit 185 in outer surface, surface area 191 of lubricant conduit 185, the height 187 of lubricant conduit 185, and the width 188 (or depth) of lubricant conduit 185 and the cross sectional area 228 of lubricant conduit 185. The perimeter length 197 of the portion of the lubricant conduit 185 which is within the permeable perimeter body 180 is also shown in FIG. 15.

FIG. 16 is a graph showing the perimeter to area ratio of the lubrication conduit for a half-circle conduit, wherein the K factor is shown to be 16.83. In FIG. 16 as one example, the radius of the half-circle may for example be 0.13 inches, the cross-sectional perimeter 0.67 inches, and the cross-sectional area 0.0265 inches squared, making the perimeter to area ratio 25.2.

The K factor, on the other hand, for the prior art lubricant conduit or groove configuration shown in FIG. 10, is approximately 43.5.

FIG. 17 is a graph showing the perimeter to area ratio of the lubrication conduit for a rectangle with an aspect ratio of 3:1, wherein the K factor is shown to be 21.333. In FIG. 17 as one example, the first cross-sectional side may for example be 0.13 inches, the second cross-sectional side may be 0.39, the cross-sectional perimeter 1.04 inches, and the cross-sectional area 0.0507 inches squared, making the perimeter to area ratio 20.5.

FIG. 18 is a graph showing the perimeter to area ratio of the lubrication conduit for a rectangle with a 1:1 aspect ratio, a square cross-section, wherein the K factor is shown to be 16. In FIG. 18 as one example, the first cross-sectional side may for example be 0.13 inches, the second cross-sectional side may be 0.13, the cross-sectional perimeter 0.52 inches, and the cross-sectional area 0.0169 inches squared, making the perimeter to area ratio 30.8.

In some aspects of the invention, it would be preferred to have a square or approximate square cross-sectional configuration, with the first cross-sectional side 0.0236 inches, the second cross-sectional side 0.0236 inches, the cross-sectional perimeter 0.0944 inches, and the cross-sectional area 0.00056 inches squared, making the perimeter to cross-sectional area ratio 168.57, and the K factor 15.9.

As will be appreciated by those of reasonable skill in the art, there are numerous embodiments to this invention, and variations of elements and components which may be used, all within the scope of this invention.

One embodiment of this invention, for example, is a permeable perimeter wall system for a metal mold, comprising: a perimeter wall body of permeable material extending around and defining a mold cavity, said body including an inner surface and an outer surface; and at least one lubricant delivery conduit at least substantially around the perimeter wall body, the at least one lubricant delivery conduit having a perimeter and a cross-sectional area; and wherein an approximate constant K equals the perimeter of the cross-sectional area of the lubricant delivery conduit squared, divided by the cross-sectional area of the lubricant delivery conduit; and further wherein the approximate constant K is less than forty. It will be appreciated by those of ordinary skill in the art that the cross-sectional shape of the lubricant conduit may be any one of a number of different shapes, all within the contemplation of this invention.

Further embodiments may be wherein the approximate constant K is less than thirty, twenty or even less than seventeen. The permeable material may be graphite.

In a further embodiment, a method embodiment, a method of designing a lubricant conduit in a permeable perimeter wall for a molten metal mold is disclosed, comprising the following: determining a perimeter of a lubricant conduit to be placed around a perimeter wall body; determining a cross-sectional area of the lubricant conduit, determining an approximate constant for a given configuration wherein the approximate constant is equal to the perimeter squared divided by the cross-sectional area of the lubricant conduit; and making the approximate constant less than forty.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A permeable perimeter wall system for a metal mold, comprising:

a permeable perimeter wall body extending around and defining a mold cavity, said wall body including an inner surface and an outer surface; and at least one lubricant delivery conduit at least substantially around the perimeter wall body and in the outer surface of the perimeter wall body, the at least one lubricant delivery conduit having a perimeter and a cross-sectional area;

wherein an approximate constant K equals the perimeter of the cross-sectional area of the lubricant delivery conduit squared, divided by the cross-sectional area of the lubricant delivery conduit; and further wherein the approximate constant K of the at least one lubricant deliver conduit in the outer surface of the perimeter wall body is less than forty.

2. A permeable perimeter wall system for a metal mold as recited in claim 1, and wherein the approximate constant K is less than thirty.

3. A permeable perimeter wall system for a metal mold as recited in claim 1, and wherein the approximate constant K is less than twenty.

4. A permeable perimeter wall system for a metal mold as recited in claim 1, and wherein the approximate constant K is less than seventeen.

5. A permeable perimeter wall system for a metal mold as recited in claim 1, and wherein the permeable material of the perimeter wall body is graphite.

6. A method of designing a lubricant conduit in a permeable perimeter wall for a molten metal mold, comprising the following:

determining a perimeter of a lubricant conduit to be located at least substantially around a perimeter wall body, and in the outer surface of the perimeter wall body;

determining a cross-sectional area of the lubricant conduit;

determining an approximate constant for a given configuration wherein the approximate constant is equal to the perimeter squared divided by the cross-sectional area of the lubricant conduit; and making the approximate constant less than forty.

7. A method of designing a lubricant conduit in a permeable perimeter wall for a molten metal mold as recited in claim 6, and further wherein the approximate constant is made to be less than thirty.

8. A method of designing a lubricant conduit in a permeable perimeter wall for a molten metal mold as recited in claim 6, and further wherein the approximate constant is made to be less than twenty.

9. A method of designing a lubricant conduit in a permeable perimeter wall for a molten metal mold as recited in claim 6, and further wherein the approximate constant is made to be less than seventeen.

* * * * *